US011140941B2

(12) United States Patent
Xanthos et al.

(10) Patent No.: US 11,140,941 B2
(45) Date of Patent: Oct. 12, 2021

(54) FOOTWEAR UPPER WITH UNITARY SUPPORT FRAME

(71) Applicant: NIKE, Inc., Beaverton, OR (US)

(72) Inventors: George A. Xanthos, Beaverton, OR (US); Katelyn Bruce, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 49 days.

(21) Appl. No.: 16/402,513

(22) Filed: May 3, 2019

(65) Prior Publication Data

US 2020/0345098 A1 Nov. 5, 2020

(51) Int. Cl.

| | |
|---|---|
| ***A43B 3/06*** | (2006.01) |
| ***A43B 3/10*** | (2006.01) |
| ***A43B 11/00*** | (2006.01) |
| ***A43C 11/00*** | (2006.01) |

(52) U.S. Cl.

CPC ..... *A43B 3/06* (2013.01); *A43B 3/10* (2013.01); *A43B 11/00* (2013.01); *A43C 11/006* (2013.01)

(58) Field of Classification Search

CPC .. A43B 3/06; A43B 11/00; A43B 3/10; A43B 3/30; A43B 3/248; A43B 23/0295; A43B 23/0275; A43B 23/26; A43B 23/0235; A43B 23/026; A43B 23/029; A43B 11/02; A43B 23/08; A43B 23/088; A43B 23/0215; A43B 3/101; A43B 3/102; A43C 11/006; A43C 11/008

USPC ..... 36/45, 58.6

See application file for complete search history.

(56) References Cited

U.S. PATENT DOCUMENTS

| | | | | | |
|---|---|---|---|---|---|
| 955,337 | A * | 4/1910 | Lawlor | A43B 11/00 | 36/105 |
| 1,478,467 | A * | 12/1923 | Binns | A43B 11/00 | 36/45 |
| 2,147,197 | A * | 2/1939 | Glidden | A43B 1/02 | 36/9 R |
| 2,413,481 | A * | 12/1946 | Ziniti | A43B 23/0245 | 36/45 |
| 2,829,448 | A * | 4/1958 | Minera | A43B 11/00 | 36/58.5 |
| 3,146,535 | A * | 9/1964 | Owings | A43B 1/0018 | 36/7.3 |

(Continued)

FOREIGN PATENT DOCUMENTS

| | | | |
|---|---|---|---|
| CN | 87209219 | U | 5/1988 |
| CN | 87103983 | A | 12/1988 |

(Continued)

*Primary Examiner* — Nathan E Durham
*Assistant Examiner* — Abby M Spatz
(74) *Attorney, Agent, or Firm* — Quinn IP Law

(57) ABSTRACT

An article of footwear has an upper including a body and a unitary support frame attached to the body. A sole structure may be attached to and underlie the upper. The unitary support frame may support the body over the sole structure, and the body may define a foot-receiving cavity over the sole structure and an ankle opening in communication with the foot-receiving cavity. The unitary support frame may define a medial peak at a medial side of the article of footwear and a lateral peak at a lateral side of the article of footwear and may extend forwardly and downwardly from the medial peak and the lateral peak.

18 Claims, 6 Drawing Sheets

(56) References Cited

U.S. PATENT DOCUMENTS 3,192,651 A * 7/1965 Smith ..... A43B 3/24 36/105
3,239,952 A * 3/1966 Lange ..... A43B 5/0488 36/117.3
3,621,592 A * 11/1971 Goldmerstein ..... A43B 3/16 36/138
4,183,156 A 1/1980 Rudy
4,219,945 A 9/1980 Rudy
4,414,761 A 11/1983 Mahood
4,547,981 A * 10/1985 Thais ..... A43B 7/00 36/114
4,670,998 A * 6/1987 Pasternak ..... A43B 5/00 36/114
4,936,029 A 6/1990 Rudy
4,959,914 A 10/1990 Hilgarth
4,972,613 A * 11/1990 Loveder ..... A43B 5/00 36/105
5,042,176 A 8/1991 Rudy
5,054,216 A * 10/1991 Lin ..... A43B 3/00 36/138
5,127,170 A 7/1992 Messina
5,184,410 A 2/1993 Hamilton
5,243,772 A * 9/1993 Francis ..... A43B 5/00 36/106
5,276,983 A * 1/1994 Hatfield ..... A43B 23/26 36/1
5,282,327 A 2/1994 Ogle
D350,021 S * 8/1994 Stein ..... D2/916
5,345,698 A 9/1994 Billet et al.
5,371,926 A * 12/1994 Van Noy ..... A43C 11/00 24/171
5,467,537 A * 11/1995 Aveni ..... A43B 11/00 24/712.1
5,481,814 A 1/1996 Spencer
5,491,909 A * 2/1996 Darby ..... A43B 11/00 36/110
5,497,564 A * 3/1996 Allen ..... A43C 5/00 36/50.1
5,555,650 A * 9/1996 Longbottom ..... A43B 3/00 36/114
5,557,866 A 9/1996 Prengler
5,692,319 A * 12/1997 Parker ..... A43B 7/1495 36/114
5,713,141 A 2/1998 Mitchell et al.
D397,240 S 8/1998 Hatfield et al.
5,813,144 A 9/1998 Prengler
5,836,094 A * 11/1998 Figel ..... A43B 3/0073 36/131
5,906,872 A * 5/1999 Lyden ..... A43B 5/00 36/103
5,952,065 A 9/1999 Mitchell et al.
5,983,530 A 11/1999 Chou
5,997,027 A 12/1999 Jungkind
6,013,340 A 1/2000 Bonk et al.
6,029,376 A 2/2000 Cass
6,082,025 A 7/2000 Bonk et al.
6,127,026 A 10/2000 Bonk et al.
6,189,239 B1 * 2/2001 Gasparovic ..... A43B 3/30 36/102
6,203,868 B1 3/2001 Bonk et al.
6,290,559 B1 9/2001 Scott
6,321,465 B1 11/2001 Bonk et al.
D452,070 S 12/2001 Holmes
6,367,171 B1 * 4/2002 Burt ..... A43B 3/102 36/100
D461,629 S 8/2002 Blakeslee
6,594,918 B2 7/2003 Hatfield et al.
6,594,921 B2 * 7/2003 Laio ..... A43B 3/24 36/105
6,606,804 B2 * 8/2003 Kaneko ..... A43B 7/1495 36/50.1
D482,861 S 12/2003 St-Louis
6,684,533 B1 2/2004 Su
6,857,204 B1 * 2/2005 Davis ..... A41B 7/02 24/442
6,877,257 B2 * 4/2005 Delgorgue ..... A43B 5/0411 36/117.1
6,938,361 B2 9/2005 Su
7,059,069 B2 6/2006 Raluy et al.
7,127,837 B2 10/2006 Ito
7,287,342 B2 * 10/2007 Keen ..... A43B 3/22 36/50.1
7,320,189 B2 * 1/2008 Clark ..... A43B 3/24 36/50.1
7,347,012 B2 * 3/2008 Clark ..... A43B 1/14 36/50.1
7,448,148 B2 11/2008 Martinez et al.
7,607,242 B2 10/2009 Karandonis et al.
7,631,440 B2 * 12/2009 Keen ..... A43B 1/14 36/50.1
7,685,740 B2 3/2010 Sokolowski
7,685,747 B1 * 3/2010 Gasparovic ..... A43C 11/002 36/102
7,757,412 B2 * 7/2010 Farys ..... A43B 5/0439 36/50.1
7,793,438 B1 * 9/2010 Busse ..... A43B 11/02 36/105
7,980,007 B2 * 7/2011 Cook ..... A43D 11/14 36/97
7,984,571 B2 7/2011 Pellegrini
8,065,819 B2 11/2011 Kaufman
8,161,669 B2 4/2012 Keating
8,225,535 B2 * 7/2012 Dillenbeck ..... A43B 3/248 36/100
8,245,418 B2 8/2012 Paintin et al.
8,245,421 B2 * 8/2012 Baudouin ..... A43B 11/00 36/103
8,312,646 B2 * 11/2012 Meschter ..... A43B 23/0235 36/45
8,365,443 B2 2/2013 Huynh
D680,719 S 4/2013 Dardinski
8,499,474 B2 8/2013 Kaufman
8,578,632 B2 * 11/2013 Bell ..... A43B 19/00 36/88
8,595,957 B2 * 12/2013 McDowell ..... A43B 23/0275 36/50.1
8,635,791 B2 1/2014 Baudouin et al.
D699,929 S * 2/2014 Restrepo ..... D2/915
8,656,613 B2 2/2014 Stockbridge et al.
8,745,893 B2 6/2014 Gavrieli et al.
8,997,380 B2 * 4/2015 Dombrow ..... A43B 23/0295 36/45
9,044,063 B2 6/2015 Loverin et al.
9,119,436 B1 9/2015 Ardell et al.
9,226,543 B2 * 1/2016 Campbell ..... A43B 23/0245
9,265,305 B2 2/2016 Hatfield et al.
9,314,067 B2 4/2016 Bock
9,363,980 B2 6/2016 Lander
9,392,844 B1 7/2016 Burrell
9,414,640 B2 * 8/2016 Nichols ..... A43B 5/14
9,445,644 B2 9/2016 Cressman et al.
9,474,330 B2 10/2016 Panian et al.
D781,561 S 3/2017 Gibson
9,591,890 B2 3/2017 Too-a-Foo
9,675,132 B2 6/2017 Marshall
9,820,527 B2 * 11/2017 Pratt ..... A43B 23/26
9,839,261 B2 12/2017 Hatfield et al.
9,854,875 B2 1/2018 Hatfield et al.
9,877,542 B2 1/2018 Pratt
9,949,533 B2 4/2018 Feinstein
D831,327 S * 10/2018 Moranges ..... D2/972
10,159,310 B2 * 12/2018 Sullivan ..... A43C 11/008
2002/0078597 A1 * 6/2002 Burt ..... A43B 11/00 36/51
2002/0139009 A1 * 10/2002 Mark ..... A43B 7/18 36/54
2003/0200680 A1 10/2003 Chang
2004/0111921 A1 * 6/2004 Lenormand ..... A43B 5/003 36/45

(56) References Cited

U.S. PATENT DOCUMENTS

2004/0205982 A1* 10/2004 Challe ..... A43B 23/07 36/55
2006/0277786 A1* 12/2006 Vattes ..... A41D 27/28 36/3 A
2007/0209234 A1 9/2007 Chou
2007/0240334 A1* 10/2007 Johnson ..... A43C 7/04 36/50.1
2008/0289222 A1* 11/2008 Candrian ..... A43B 13/22 36/101
2010/0319216 A1 12/2010 Grenzke et al.
2011/0010964 A1* 1/2011 Hardy ..... A43B 13/182 36/103
2011/0016751 A1 1/2011 Somerville
2011/0113646 A1* 5/2011 Merritt ..... A43B 13/145 36/28
2011/0247238 A1 10/2011 Chestnut
2011/0271556 A1* 11/2011 Dillenbeck ..... A43B 3/248 36/100
2012/0079746 A1 4/2012 Ferreira et al.
2012/0180338 A1* 7/2012 Lin ..... A43B 23/0215 36/56
2012/0198730 A1 8/2012 Burch et al.
2012/0204450 A1 8/2012 Girbaud
2012/0255200 A1* 10/2012 Oda ..... A43B 23/0215 36/45
2012/0317836 A1* 12/2012 Voorhees ..... A43B 23/26 36/54
2013/0019508 A1 1/2013 Smith et al.
2013/0104422 A1* 5/2013 Hatfield ..... A43B 7/142 36/103
2013/0312284 A1* 11/2013 Berend ..... A43B 1/0072 36/84
2014/0000131 A1 1/2014 Meschter et al.
2014/0096415 A1 4/2014 Long
2014/0137433 A1* 5/2014 Craig ..... A43B 1/04 36/50.1
2014/0237858 A1* 8/2014 Adami ..... A43B 23/0255 36/107
2014/0259760 A1* 9/2014 Dojan ..... A43B 23/0275 36/45
2014/0298687 A1 10/2014 Flinterman et al.
2015/0020416 A1* 1/2015 Wiens ..... A43B 23/0295 36/102
2015/0040429 A1* 2/2015 Beers ..... A43B 3/0005 36/83
2015/0047223 A1 2/2015 Flinterman et al.
2015/0047227 A1* 2/2015 Fallon ..... A43B 23/17 36/88
2015/0096197 A1 4/2015 Salinas
2015/0216252 A1* 8/2015 Wiens ..... A43B 11/00 36/105
2015/0305442 A1* 10/2015 Ravindran ..... A43B 23/28 36/138
2015/0374065 A1 12/2015 DiFrancisco
2016/0166006 A1* 6/2016 DiFrancisco ..... A43B 3/26 36/105
2016/0168774 A1* 6/2016 Breithaupt ..... D04H 1/76 36/50.1
2016/0302530 A1 10/2016 Smith et al.
2016/0374427 A1 12/2016 Zahabian
2017/0049190 A1 2/2017 Maussen
2017/0055630 A1* 3/2017 Marshall ..... A43B 3/24
2017/0099906 A1 4/2017 Figueroa
2017/0303632 A1* 10/2017 Pratt ..... A43B 3/248
2017/0360143 A1 12/2017 Pratt et al.
2017/0360155 A1* 12/2017 Leary ..... A43B 23/0235
2018/0110287 A1* 4/2018 Hopkins ..... A43B 3/248
2018/0110288 A1* 4/2018 Hatfield ..... A43B 11/02
2018/0110289 A1* 4/2018 Owings ..... A43B 1/14
2018/0206588 A1 7/2018 Pratt et al.
2018/0213882 A1* 8/2018 Morse ..... A43B 11/00
2018/0213890 A1 8/2018 Innocente
2018/0235314 A1* 8/2018 Farage ..... A43B 23/0245
2018/0263332 A1* 9/2018 Bruno ..... A43B 13/188
2018/0295942 A1 10/2018 Drake
2020/0000178 A1* 1/2020 Pratt ..... A43B 21/32

FOREIGN PATENT DOCUMENTS

CN 2052208 U 2/1990
CN 2161101 Y 4/1994
CN 2262929 Y 9/1997
CN 2268406 Y 11/1997
CN 2275814 Y 3/1998
CN 2281094 Y 5/1998
CN 2384464 Y 6/2000
CN 2456500 Y 10/2001
CN 2482829 Y 3/2002
CN 1403041 A 3/2003
CN 1565297 A 1/2005
CN 2712118 Y 7/2005
CN 1720835 A 1/2006
CN 2783792 Y 5/2006
CN 2819852 Y 9/2006
CN 1278639 C 10/2006
CN 1943463 A 4/2007
CN 2901950 Y 5/2007
CN 201005111 Y 1/2008
CN 201157014 Y 12/2008
CN 201167619 Y 12/2008
CN 101485505 A 7/2009
CN 101518380 A 9/2009
CN 201426430 Y 3/2010
CN 201504620 U 6/2010
CN 101500446 B 1/2011
CN 201743039 U 2/2011
CN 101986920 A 3/2011
CN 201831038 U 5/2011
CN 102159288 A 8/2011
CN 201967803 U 9/2011
CN 102256673 A 11/2011
CN 202211219 U 5/2012
CN 101991227 B 8/2012
CN 202819794 U 3/2013
CN 203121188 U 8/2013
CN 203137220 U 8/2013
CN 203841187 U 9/2014
CN 203884822 U 10/2014
CN 203913577 U 11/2014
CN 204070772 U 1/2015
CN 104394729 A 3/2015
CN 205040743 U 2/2016
CN 105876979 A 8/2016
CN 205568021 U 9/2016
CN 205658453 U 10/2016
CN 205671573 U 11/2016
CN 205795015 U 12/2016
CN 206025369 U 3/2017
CN 107692396 A 2/2018
CN 107921318 A 4/2018
CN 207544444 U 6/2018
CN 207949063 U 10/2018
DE 102004005288 A1 8/2005
DE 102009023689 A1 12/2010
DE 202016001813 U1 6/2017
EP 0548116 B1 12/1994
EP 1059044 A1 12/2000
EP 1593315 B1 5/2008
EP 1952715 A1 8/2008
EP 2173208 B1 12/2010
EP 2036449 B1 4/2013
EP 2848141 A1 3/2015
EP 2937007 A1 10/2015
EP 3167742 A1 5/2017
ES 1214014 U 6/2018
FR 2980958 A1 4/2013
KR 20130119566 A 11/2013
NL 1020208 C1 9/2003
TW 585748 B 5/2004
TW M275736 U 9/2005
TW 200930315 A 7/2009
TW 201130440 A 9/2011

(56) References Cited

FOREIGN PATENT DOCUMENTS

| | | | |
|---|---|---|---|
| TW | M449484 | U | 4/2013 |
| TW | M469778 | U | 1/2014 |
| TW | I581730 | B | 5/2017 |
| WO | 9737556 | A1 | 10/1997 |
| WO | 03039283 | A1 | 5/2003 |
| WO | 2005070246 | A2 | 8/2005 |
| WO | 2008152414 | A1 | 12/2008 |
| WO | 2010048203 | A1 | 4/2010 |
| WO | 2011140584 | A1 | 11/2011 |
| WO | 2013039385 | A1 | 3/2013 |
| WO | 2013187288 | A1 | 12/2013 |
| WO | 2014033396 | A1 | 3/2014 |
| WO | 2014038937 | A1 | 3/2014 |
| WO | 2014140443 | A1 | 9/2014 |
| WO | 2015002521 | A1 | 1/2015 |
| WO | 2015198460 | A1 | 12/2015 |
| WO | 2016015161 | A1 | 2/2016 |
| WO | 2016055642 | A1 | 4/2016 |
| WO | 2018092023 | A1 | 5/2018 |
| WO | 2018193276 | A1 | 10/2018 |

* cited by examiner

FOOTWEAR UPPER WITH UNITARY SUPPORT FRAME

TECHNICAL FIELD

The present disclosure generally relates to an article of footwear that includes an upper that has a body and a unitary support frame attached to the body.

BACKGROUND

Footwear may include a sole structure configured to be located under a wearer's foot to space the foot away from the ground. A footwear upper may be attached to the sole structure and may provide a foot-receiving cavity that receives the foot.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
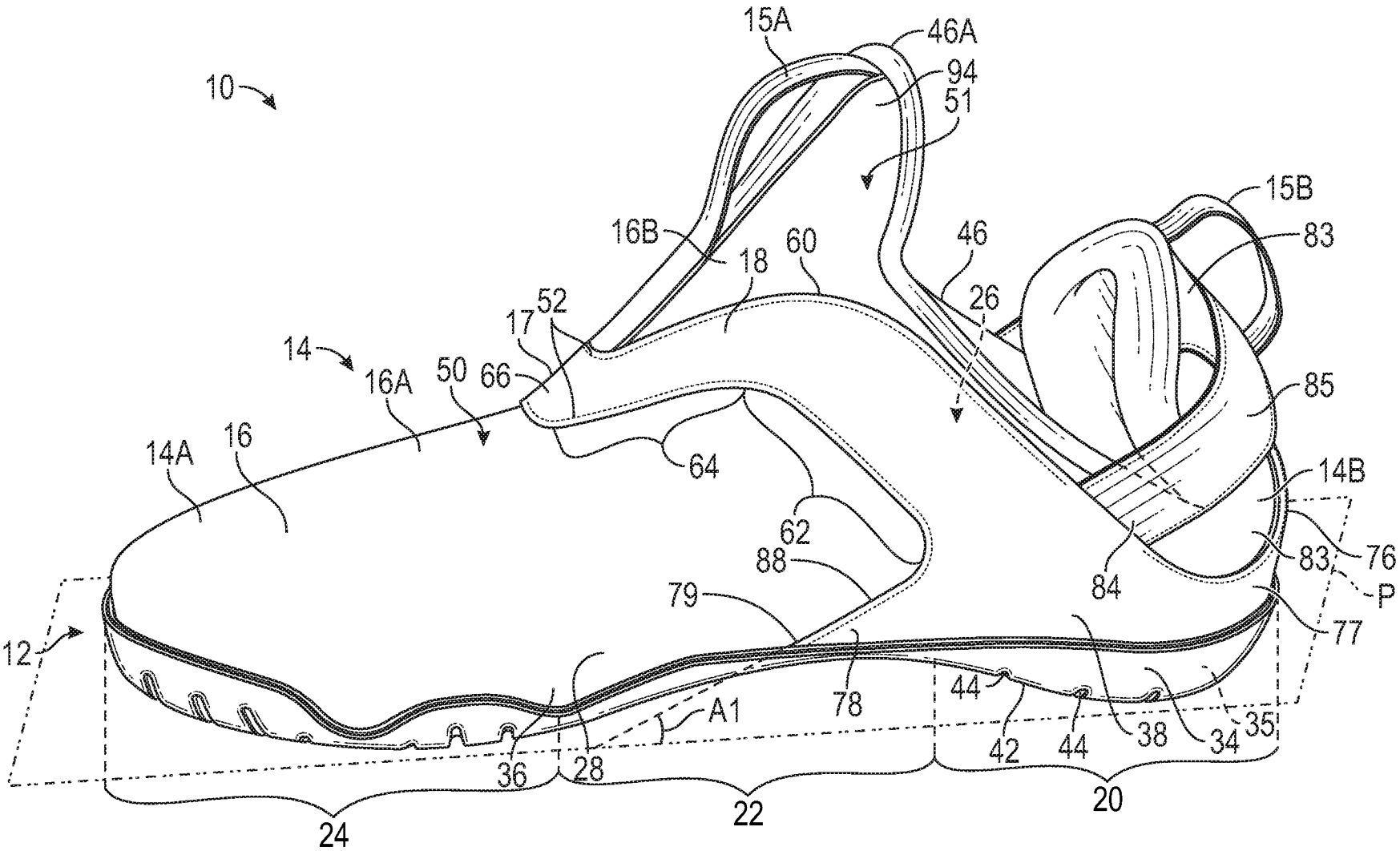
FIG. 1 is a perspective medial side view of an article of footwear.

The present disclosure generally relates to an article of footwear in which the body of an upper has a unitary support frame attached to it. The unitary support frame supports the body around the foot-receiving cavity to prevent the body from collapsing inward when a foot is not within the foot-receiving cavity. Stated differently, the unitary support frame provides a structure to hold the body lifted above the sole structure and helps to present the ankle opening at its full width even when the foot-receiving cavity is empty. In this manner, the comfort of a relatively thin and flexible body is afforded, without the attendant drawbacks of the potential inability of such a body to maintain a desired shape on its own when empty.

In an example, an article of footwear comprises an upper including a body and a unitary support frame attached to the body. A sole structure may be attached to and underlie the upper. The unitary support frame may support the body over the sole structure, and the body may define a foot-receiving cavity over the sole structure and an ankle opening in communication with the foot-receiving cavity. The unitary support frame may define a medial peak at a medial side of the article of footwear and a lateral peak at a lateral side of the article of footwear and may extend forwardly. The unitary support frame may extend downwardly from the medial peak and the lateral peak. The unitary support frame may be secured to an exterior surface of the body, so that the body is suspended from the unitary support frame above the foot-receiving cavity. The unitary support frame may be relatively more rigid than the body, and the body may be relatively more flexible than the unitary support frame.

In one or more implementations, the unitary support frame may have a shape that acts as an overhang support for the body forward of the ankle opening. For example, the unitary support frame may extend continuously from the sole structure at the medial side in a heel region of article of footwear, over the foot-receiving cavity forward of the ankle opening, and to the sole structure at the lateral side in the heel region. The unitary support frame may have a first medial segment extending upwardly and forwardly on the medial side to the medial peak, a first lateral segment extending upwardly and forwardly on the lateral side to the lateral peak, and a front segment extending downwardly and forwardly from the medial peak and the lateral peak. The peaks establish support for the body sufficiently high above the sole structure so that the front segment is held above the sole structure by the buttressing of the first medial segment and the first lateral segment.

In one or more configurations, the front segment may define a front peak disposed over a central top region of the body and forward of the ankle opening so that the portion of the body forward of the front peak is suspended from the front segment.

Padding may also be used in conjunction with the unitary support frame to maintain the desired open shape of the ankle opening without collapse of the body. For example, the article of footwear may further comprise padding secured to the body and extending rearward of the front segment of the unitary support frame to a forward edge of the ankle opening. For example, the padding may extend upwardly and rearwardly of the front segment of the unitary support frame and may partially define a tongue. The padding may be thicker than the body. That portion of the body disposed forward of the front segment of the unitary support frame may be characterized by an absence of padding. Accordingly, placement of the padding rearward of the front segment, and between the front segment and the forward edge of the ankle opening (e.g., the tongue portion of the body) sufficiently holds the ankle opening in a desired shape for easy foot entry without requiring extensive use of the padding over the forward portion of the foot-receiving cavity, reducing the weight of the footwear and maintaining the flexibility of the relatively lightweight body where it extends forward of the front segment without the need for coextensive padding.

The body may comprise a first material disposed forward of the front segment of the unitary support frame, and a second material disposed rearward of the front segment of the unitary support frame to the ankle opening, the second material further defining the tongue. For example, the second material may be relatively thicker and/or denser than the first material, providing further support to maintain the open shape of the ankle opening even when the footwear is not being worn.

In addition to the medial peak, lateral peak, and front segment, the unitary support frame may include a base extending along the sole structure at a rear of the heel region from the lateral side to the medial side. The base provides further anchoring support for the first medial segment and the first lateral segment that extend to the medial and lateral peaks, respectively. For example, the first lateral segment and the first medial segment may extend upwardly from the base. The base may also extend forward to provide further support for the first lateral segment, the first medial segment, and the front segment. For example, the base may include a medial arm extending forwardly under the first medial segment, and a lateral arm extending forwardly under the first lateral segment. The medial arm may taper in a forward direction of the article of footwear to a medial extremity in a midfoot region of the article of footwear. Similarly, the lateral arm may taper in the forward direction to a lateral extremity in the midfoot region.

The unitary support frame may also include a heel support segment that extends upwardly from the base at the rear of the heel region. This may be especially useful in a configuration in which the upper comprises a front section and a hinged heel section, with the front section including the body and the hinged heel section being pivotable relative to the body at the rear of the heel region. By extending upward from the base at the rear of the heel region, the unitary support frame may help to bias the hinged heel section in a closed position, also referred to as a use position. Moreover, the upper may comprise an elastic heel band that extends around the hinged heel section from the medial side to the lateral side. The elastic heel band may bias the hinged heel section to the closed position. The elastic heel band may extend upwardly and rearwardly from the front section at the medial side and at the lateral side at a first angle relative to a horizontal plane (e.g., when the sole structure is resting on the horizontal plane). The base may include a medial arm extending forwardly under the first medial segment, and a lateral arm extending forwardly under the first lateral segment. An edge of the medial arm of the base and an edge of the lateral arm of the base may extend upwardly and rearwardly from the sole structure at the first angle relative to the horizontal plane. With this configuration, tensile forces on the elastic heel band may act against and be widely dispersed over the unitary support frame and the sole structure to which it is attached, including over the medial arm and the lateral arm of the base.

The upper may further comprise a first pull loop secured to the front section forward of the ankle opening, and a second pull loop secured to the hinged heel section rearward of the ankle opening. The pull loops may be utilized to hold the upper while inserting or withdrawing the foot from the foot-receiving cavity.

The article of footwear may be well-suited for persons who stand for extended periods of time, such as health care workers, food service workers, and others. The sole structure may provide sufficient support and resilient comfort, while the lightweight body, unitary support frame, and pivotable heel section of the upper make the footwear easy to place on and take off of the foot. Moreover, an exterior surface of the body may be impermeable to liquid which may be encountered in many professions such as those mentioned above. For example, the body may comprise natural or synthetic leather, or one or more other relatively impermeable and flexible materials or composites of materials.

The above features and advantages and other features and advantages of the present teachings are readily apparent from the following detailed description of the modes for carrying out the present teachings when taken in connection with the accompanying drawings.

Referring to the drawings, wherein like reference numbers refer to like components throughout the views, FIG. 1 shows an article of footwear 10 with a sole structure 12 and a footwear upper 14. The footwear upper 14 includes a body 16 and a unitary support frame 18 that supports the body 16 over the sole structure 12, inhibiting collapse of the body 16 as described herein, among other features and advantages. The footwear 10 herein is depicted as a work shoe, a leisure shoe or an athletic shoe, but the present teachings also include an article of footwear that is a dress shoe, a sandal, a slipper, a boot, or any other category of footwear. As described herein, the features of the footwear 10 may make it suitable for workers who spend a significant amount of time standing, and work in environments that include liquids. For example, hospital workers such as doctors or nurses may benefit from use of the footwear 10.

Figure 2:
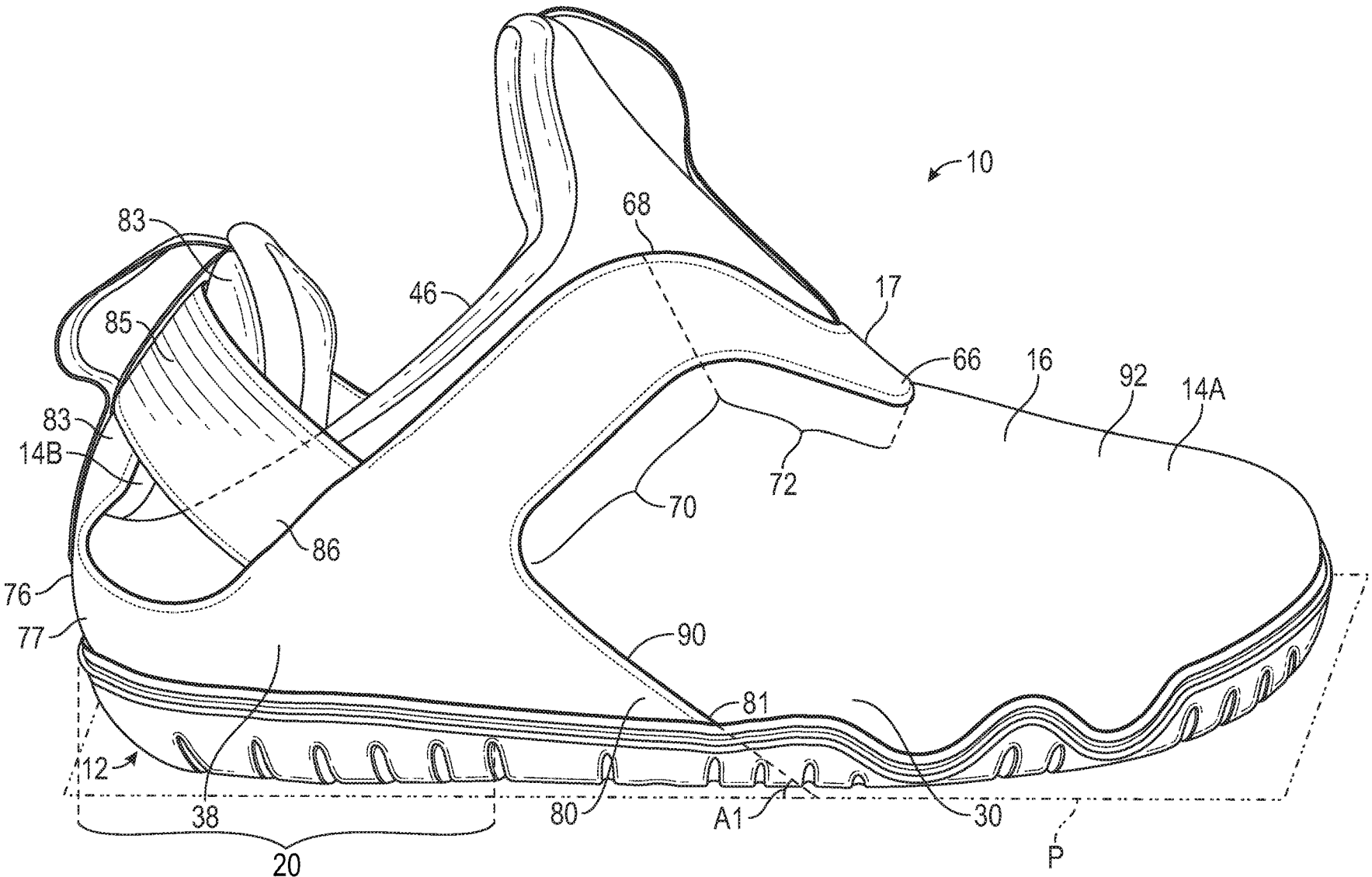
FIG. 2 is a perspective lateral side view of the article of footwear of FIG. 1.

The article of footwear 10 has a heel region 20, as well as a midfoot region 22 and a forefoot region 24. The heel region 20 generally includes portions of the article of footwear 10 corresponding with rear portions of a human foot, including the calcaneus bone, when the human foot of a size corresponding with the article of footwear 10 is disposed in a foot-receiving cavity 26 defined by the body 16 of the upper 14, and is supported on the sole structure 12. The forefoot region 24 of the article of footwear 10 generally includes portions of the article of footwear 10 corresponding with the toes and the joints connecting the metatarsals with the phalanges of the human foot (interchangeably referred to herein as the "metatarsal-phalangeal joints" or "MPJ" joints). The midfoot region 22 of the article of footwear 10 is disposed between the heel region 20 and the forefoot region 24 and generally includes portions of the article of footwear 10 corresponding with an arch area of the human foot, including the navicular joint. FIG. 1 shows a medial side 28 of the footwear 10, and FIG. 2 shows a lateral side 30 of the footwear 10. The medial side 28 and the lateral side 30 both extend from the heel region 20 to the forefoot region 24 and are generally opposite sides of the footwear 10 divided by a longitudinal midline of the footwear 10.

The sole structure 12 includes one or more sole components that may be sole layers 34, such as an outsole 42, a midsole 35, or a unitary combination of an outsole and a midsole that may be referred to as a unisole. In the embodiment shown, the midsole 35 is not visible because the outsole 42 wraps up and covers the sides of the midsole 35. The sole structure 12 underlies the upper 14. A lower portion 36 of the upper 14 as well as a base 38 of the unitary support frame 18 may be secured to the sole structure 12, such as by stitching, adhesive or otherwise.

The sole structure 12 may comprise, for example, a midsole 35 of an elastomeric foam such as a polyurethane or ethylvinylacetate foam to attenuate ground reaction forces (e.g., provide cushioning) when compressed between the foot and the ground during walking, running, or other ambulatory activities. In further configurations, the sole structure 12 may incorporate fluid-filled chambers, plates, moderators, or other elements in the midsole that further attenuate forces, enhance stability, or influence the motions of the foot. In the embodiment shown, the midsole 35 may be at least partially a polyurethane foam, and/or a polyurethane ethylene-vinyl acetate (EVA) foam and may include heat-expanded and molded EVA foam pellets. The midsole 35 may generally include phylon (ethylene vinyl acetate or "EVA") and/or polyurethane ("PU") base resins. If EVA is used, it may have a vinyl acetate (VA) level between approximately 9% and approximately 40%. Suitable EVA resins include Elvax®, provided by E. I. du Pont de Nemours and Company, and Engage™, provided by the Dow Chemical Company, for example. In certain embodiments, the EVA may be formed of a combination of high melt index and low melt index material. For example, the EVA may have a melt index of from about 1 to about 50. The EVA resin may be compounded to include various components including a blowing agent and a curing/crosslinking agent. The blowing agent may have a percent weight between approximately 10% and approximately 20%. The blowing agent may be thermally decomposable and is selected from ordinary organic and inorganic chemical blowing agents. The nature of the blowing agent is not particularly limited as long as it decomposes under the temperature conditions used in incorporating the foam into the virgin resin. Suitable blowing agents include azodicarboamide, for example. In certain embodiments, a peroxide-based curing agent, such as dicumyl peroxide may be used. The amount of curing agent may be between approximately 0.6% and approximately 1.5%. The EVA may also include homogenizing agents, process aids, and waxes. For example, a mixture of light aliphatic hydrocarbons such as Struktol® 60NS, available from Schill+Seilacher "Struktol" GmbH, may be included to permit other materials or scrap EVA to be more easily incorporated into the resin. The EVA may also include other constituents such as a release agent (e.g., stearic acid), activators (e.g., zinc oxide), fillers (e.g., magnesium carbonate), pigments, and clays. In embodiments that incorporate multiple materials, each material may be formed from a material that is compatible and readily bonds with the other material. For example, the materials may each be formed from an EVA resin with suitable blowing agents, crosslinking agents, and other ancillary components, pigments, fillers, and the like. Other suitable materials will become readily apparent to those skilled in the art, given the benefit of this disclosure.

The midsole 35 may comprise one or more bladder elements that may be blow-molded or formed from polymeric sheets that may comprise a variety of materials including various polymers that can resiliently retain a fluid such as air or another gas. Examples of polymer materials for the polymeric sheets include thermoplastic urethane, polyurethane, polyester, polyester polyurethane, and polyether polyurethane. Moreover, the polymeric sheets can each be formed of layers of different materials. In one embodiment, each polymeric sheet is formed from thin films having one or more thermoplastic polyurethane layers with one or more barrier layers of a copolymer of ethylene and vinyl alcohol (EVOH) that is impermeable to the pressurized fluid contained therein as disclosed in U.S. Pat. No. 6,082,025, which is incorporated by reference in its entirety. Each polymeric sheet may also be formed from a material that includes alternating layers of thermoplastic polyurethane and ethylene-vinyl alcohol copolymer, as disclosed in U.S. Pat. Nos. 5,713,141 and 5,952,065 to Mitchell et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. The polymeric sheets may also each be a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Additional suitable materials for the polymeric sheets are disclosed in U.S. Pat. Nos. 4,183,156 and 4,219,945 to Rudy which are incorporated by reference in their entireties. Further suitable materials for the polymeric sheets include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the polymeric sheets, engineering properties such as tensile strength, stretch properties, fatigue characteristics, dynamic modulus, and loss tangent can be considered. The thicknesses of polymeric sheets can be selected to provide these characteristics.

The sole structure 12 may include the outsole 42 or outsole portions that may be formed from materials that may generally include natural or synthetic rubber or other suitably durable materials. The material or materials for the outsole 42 may be selected to provide a desirable combination of durability and flexibility. Synthetic rubbers that may be used include ethylene propylene rubber (EPR), styrene isoprene styrene (SIS) copolymer rubber, and styrene butadiene rubber. As shown, the outsole 42 includes grooves 44 or sipes that may provide channels for the distribution and disbursement of liquids that may be underfoot, promoting traction of the outsole 42 even in wet environments.

The body 16 of the upper 14 defines at least a portion of an ankle opening 46 that is in communication with the foot-receiving cavity 26. The foot enters into the foot-receiving cavity 26 through the ankle opening 46. As further discussed herein, the upper 14 comprises a front section 14A and a hinged heel section 14B. The front section 14A includes the body 16, and the hinged heel section 14B is pivotable relative to the body 16 at a pivot axis P extending laterally (e.g., transversely) near the rear of the heel region 20 as discussed with respect to FIG. 6. The upper 14 also includes a first pull loop 15A secured to the front section 14A forward of the ankle opening 46, and a second pull loop 15B secured to the hinged heel section 14B rearward of the ankle opening 46. The pull loops 15A, 15B may be utilized to hold the upper 14 while inserting or withdrawing the foot from the foot-receiving cavity 26.

The upper 14 may include one or more layers of one or more materials and serves as a covering for receiving and at least partially covering the foot and maintaining the foot in a desired position on the sole structure 12. For example, the upper 14 may include a variety of materials such as textiles, composites, knitted, braided, or woven layers. In one example, the body 16 of the upper 14 may be a relatively flexible material that is also relatively impermeable to liquids. For example, a front section 16A of the body 16 forward of a front segment 17 of the unitary support frame 18 may be a first material at an exterior surface 50 of the body 16, such as a natural or synthetic leather, and a tongue portion 16B of the body 16 rearward of the front segment 17 to the ankle opening 46 may be a second material at an exterior surface 51, such as suede that is also relatively impermeable to liquids. The second material further defines a tongue 94 of the upper 14. For example, the second material may be relatively thicker and/or more dense than the first material, providing further support to maintain the open shape of the ankle opening 46 even when the footwear 10 is not being worn (e.g., even when there is no foot in the foot-receiving cavity 26).

In order to provide a flexible, relatively lightweight and liquid impermeable body 16, the unitary support frame 18 is configured with a specific shape, is dimensioned, and is comprised of a material or materials that enable it to support the body 16 above the sole structure 12 so that the body 16 is inhibited from collapsing toward the sole structure 12 and defines a predetermined shape of the foot-receiving cavity 26 even when no foot is disposed in the foot-receiving cavity 26.

The unitary support frame 18 is configured to be relatively more rigid than the body 16. For example, the material of the unitary support frame 18 may have a bending stiffness that is greater than that of the material or materials used for the body 16. The unitary support frame 18 may be a composite that includes a thermoplastic polyurethane, for example, and the body 16 may be a natural or synthetic leather or other relatively flexible and less rigid material. The unitary support frame 18 may also be thicker than the body 16 so that, even if it is the same material as the body 16, its thickness causes it to be more rigid. As shown in FIG. 1, the unitary support frame 18 is stitched to the exterior surface 50 of the body 16 at stitching 52. By securing the unitary support frame 18 to the exterior surface 50 of the body 16, the body 16 is suspended from the unitary support frame 18 above the portion of the foot-receiving cavity 26 that is defined between the body 16 and the sole structure 12. As shown, the unitary support frame 18 is a relatively flat strip of material that is wider than it is thick.

The unitary support frame 18 extends continuously from the sole structure 12 at the medial side 28 in the heel region 20 of article of footwear (best shown in FIG. 1), over the foot-receiving cavity 26 forward of the ankle opening 46 (best shown in FIG. 3), and to the sole structure 12 at the lateral side 30 in the heel region 20 (best shown in FIG. 2). By extending continuously from the sole structure 12 at the medial side 28 to the sole structure 12 at the lateral side 30, and by being attached to the exterior surface 50 of the body 16 continuously without break from the sole structure 12 at the medial side 28 to the sole structure 12 at the lateral side 30 while extending forward of the ankle opening 46 between the medial side 28 and the lateral side 30, the unitary support frame 18 functions as an arch that holds the body 16 above the sole structure 12.

Moreover, the unitary support frame 18 has a shape that allows it to function as an overhang support for the body 16 forward of the ankle opening 46. For example, with reference to FIG. 1, the unitary support frame 18 defines a medial peak 60 at the medial side 28 of the article of footwear 10. More specifically, the unitary support frame 18 has a first medial segment 62 that extends upwardly and forwardly on the medial side 28 to the medial peak 60. The front segment 17 of the unitary support frame 18 includes a second medial segment 64 that extends downwardly and forwardly from the medial peak 60 to a front peak 66 defined by the front segment 17. With reference to FIG. 2, the unitary support frame 18 defines a lateral peak 68 at the lateral side 30 of the article of footwear 10. The unitary support frame 18 includes a first lateral segment 70 extending upwardly and forwardly on the lateral side 30 to the lateral peak 68. The front segment 17 includes a second lateral segment 72 that extends downwardly and forwardly from the lateral peak 68 to the front peak 66 of the front segment 17. The medial peak 60 and the lateral peak 68 are higher than the front peak 66. The unitary support frame 18 thus establishes support for the body 16 sufficiently high above the sole structure 12 that the front segment 17 is held above the sole structure 12 by the buttressing of the first medial segment 62 and the first lateral segment 70.

In addition to the segments 62, 64 defining the medial peak 60, the segments 70, 72 defining the lateral peak 68, and the front segment 17 defining the front peak 66, the unitary support frame 18 also includes a base 38 that extends along the sole structure 12 at a rear 76 of the heel region 20 from the medial side 28 to the lateral side 30. The base 38 provides further anchoring support for the first medial segment 62, the first lateral segment 70, and the front segment 17 supported by the segments 62, 70.

The base 38 extends both rearward and forward of the first medial segment 62 and the first lateral segment 70 to buttress these segments and their ability to support the front segment 17 and the body 16 attached thereto. For example, the first medial segment 62 and the first lateral segment 70 extend upwardly and forwardly from the base 38. A rear portion 77 of the base 38 is rearward of the first medial segment 62 and the first lateral segment 70 and wraps around the rear 76 of the heel region 20. The base 38 also extends forward of the first medial segment 62 and the first lateral segment 70 to provide further support for the first medial segment 62, the first lateral segment 70, and the front segment 17. For example, with reference to FIG. 1, the base 38 includes a medial arm 78 extending forwardly under the first medial segment 62. The medial arm 78 tapers in a forward direction of the article of footwear 10 to a medial extremity 79 in the midfoot region 22. With reference to FIG. 2, the base 38 includes a lateral arm 80 extending forwardly under the first lateral segment 70. Similarly, the lateral arm 80 tapers in the forward direction to a lateral extremity 81 in the midfoot region 22. Because the arms 78, 80 extend forward under the segments 62, 70 and become wider in a rearward direction from the extremities 79, 81 until meeting the segments 62, 70, the arms 78, 80 function as braces for the segments 62, 70, and particularly for the forces exerted on the segments 62, 70 by the weight of the body 16 secured to the forward-leaning medial and lateral segments 62, 70 and to the unitary support frame 18 forward of the segments 62, 70 (e.g., to the front segment 17).

In addition, the rear portion 77 of the base 38 also provides support to the segments 62, 70, 17 and the forces of the body 16 exerted thereon. The unitary support frame 18 also includes a heel support segment 83 that extends upwardly from the base 38 at the rear 76 of the heel region 20 from the rear portion 77. The heel support segment 83 is traversed by an elastic heel band 85 that extends around the hinged heel section 14B from the medial side 28 to the lateral side 30. The elastic heel band 85 biases the hinged heel section 14B to the closed position shown in FIGS. 1-3 (also referred to as a use position). Due to the downward and forward slant of the elastic heel band 85, the heel support segment 83 is also pulled forward and inward toward the foot-receiving cavity 26 by the elastic heel band 85. As shown in FIG. 1, a medial portion 84 of the elastic heel band 85 is secured to the base 38, or to the body 16 under the base, or may extend all the way to the sole structure 12 under the base 38 and be secured to the sole structure 12. If secured to the base 38, for example, the elastic heel band 85 acts on the base 38 rearward of the first medial segment 62. As shown in FIG. 2, a lateral portion 86 of the elastic heel band 85 is secured to the base 38, or to the body 16 under the base, or may extend all the way to the sole structure 12 under the base 38 and be secured to the sole structure 12. If secured to the base 38, for example, the elastic heel band 85 acts on the base 38 rearward of the first lateral segment 70. In this manner, the rearward and upward pull of the elastic heel band 85 on the base 38 at the medial and lateral sides of the unitary support frame 18 may help to counter the forward and downward forces exerted on the front segment 17 of the unitary support frame 18 by the weight of the body 16.

The arms 78, 80 and the elastic heel band 85 may be configured to extend at common angles relative to the sole structure 12 so that forces on the unitary support frame 18 are dispersed over a broad portion of the sole structure 12. As shown in FIG. 2, the elastic heel band 85 extends upwardly and rearwardly from the front section 14A at the medial side 28 and at the lateral side 30 at a first angle μl relative to a horizontal plane P. As shown in FIG. 1, an edge 88 of the medial arm 78 of the base 38 extends upwardly and rearwardly from the sole structure 12 at the same first angle μl to the horizontal plane P. As shown in FIG. 2, an edge 90 of the lateral arm 80 of the base 38 also extends upwardly and rearwardly from the sole structure 12 at the first angle μl to the horizontal plane P. Forces exerted on the unitary support frame 18, including any forces that may be exerted by the elastic heel band 85 on the unitary support frame 18, are thus dispersed over all of the sole structure 12 that is rearward of the extremities 79, 81, as the unitary support frame 18 is secured to the entire perimeter of the sole structure 12 from the extremities 79, 81 rearward.

Figure 3:
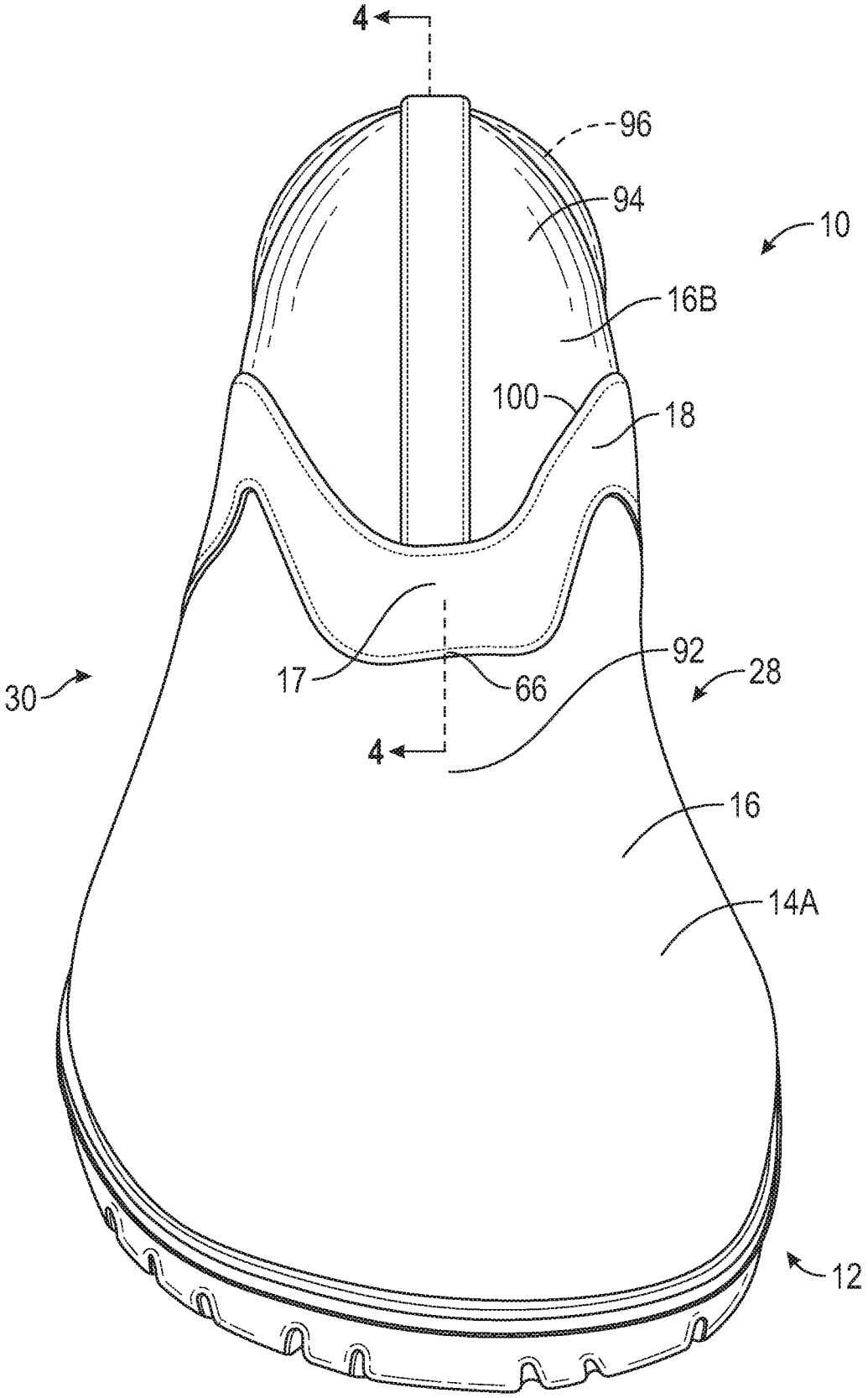
FIG. 3 is a perspective front view of the article of footwear of FIG. 1.
Figure 4:
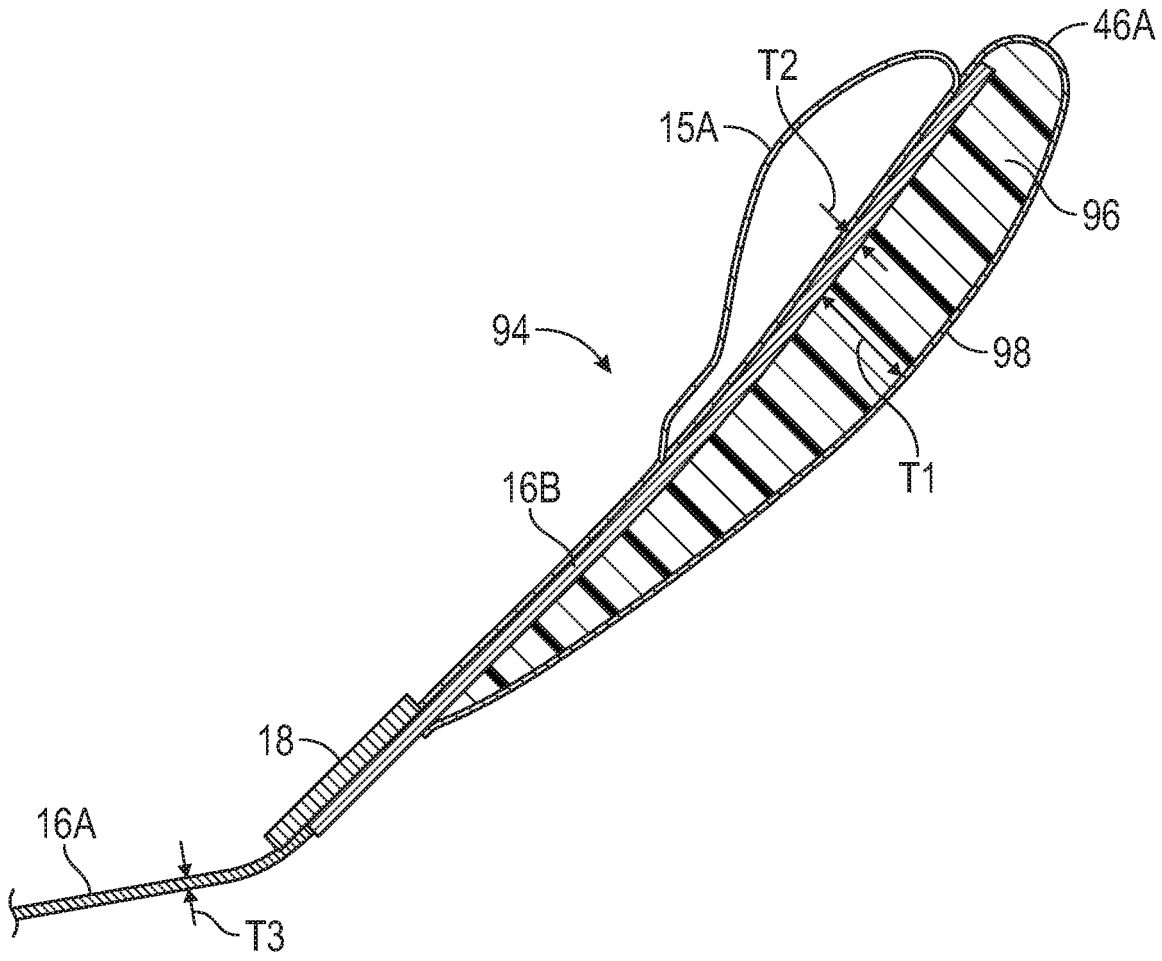
FIG. 4 is a fragmentary cross-sectional view of the article of footwear of FIG. 1 taken at lines 4-4 in FIG. 3.

With reference to FIG. 3, the front peak 66 of the front segment 17 is disposed over a central top region 92 of the body 16 forward of the ankle opening 46 (as indicated in FIG. 2). The portion of the body 16 forward of the front peak 66 is suspended from the front segment 17. FIG. 3 also shows a tongue 94 covered by the tongue portion 16B of the body 16. The front section 14A also includes padding 96 that is used in conjunction with the unitary support frame 18 to maintain the desired open shape of the ankle opening 46 without collapse of the body 16. For example, as best shown in FIG. 4, the padding 96 is disposed between the tongue portion 16B of the body and an inner lining 98 of the tongue 94 disposed at the foot-receiving cavity 26. The inner lining 98 is stitched or otherwise secured to the tongue portion 16B around the padding 96. The padding 96 is thus secured to the body 16 at the tongue portion 16B, and extends rearward of the front segment 17 of the unitary support frame 18 to a forward edge 46A of the ankle opening 46. The padding 96 extends upwardly and rearwardly of the front segment 17 and partially defines the tongue 94. The padding 96 is thicker than the body 16, as indicated by the thickness T1 of the padding 96 being larger than the thickness T2 of the tongue portion 16B of the body 16. The thickness T1 of the padding 96 is also greater than the thickness T3 of the front section 16A of the body 16. As in the embodiment shown, the front section 16A of the body 16 disposed forward of the front segment 17 of the unitary support frame 18 may have no padding (e.g., may be characterized by an absence of padding). The padding 96 is coextensive with the tongue portion 16B and extends under the tongue portion 16B of the body 16 along the entire upper edge 100 of the unitary support frame 18 (shown in FIG. 3) rearward to the forward edge 46A of the ankle opening 46. Placement of the padding 96 rearward of the front segment 17, and between the front segment 17 and the forward edge 46A of the ankle opening 46 sufficiently holds the ankle opening 46 in a desired shape for easy foot entry without requiring use of the padding under the front section 16A, e.g., over the forward portion of the foot-receiving cavity 26, reducing the weight of the footwear 10 and maintaining the flexibility of the relatively lightweight front section 16A of the body 16.

Figure 5:
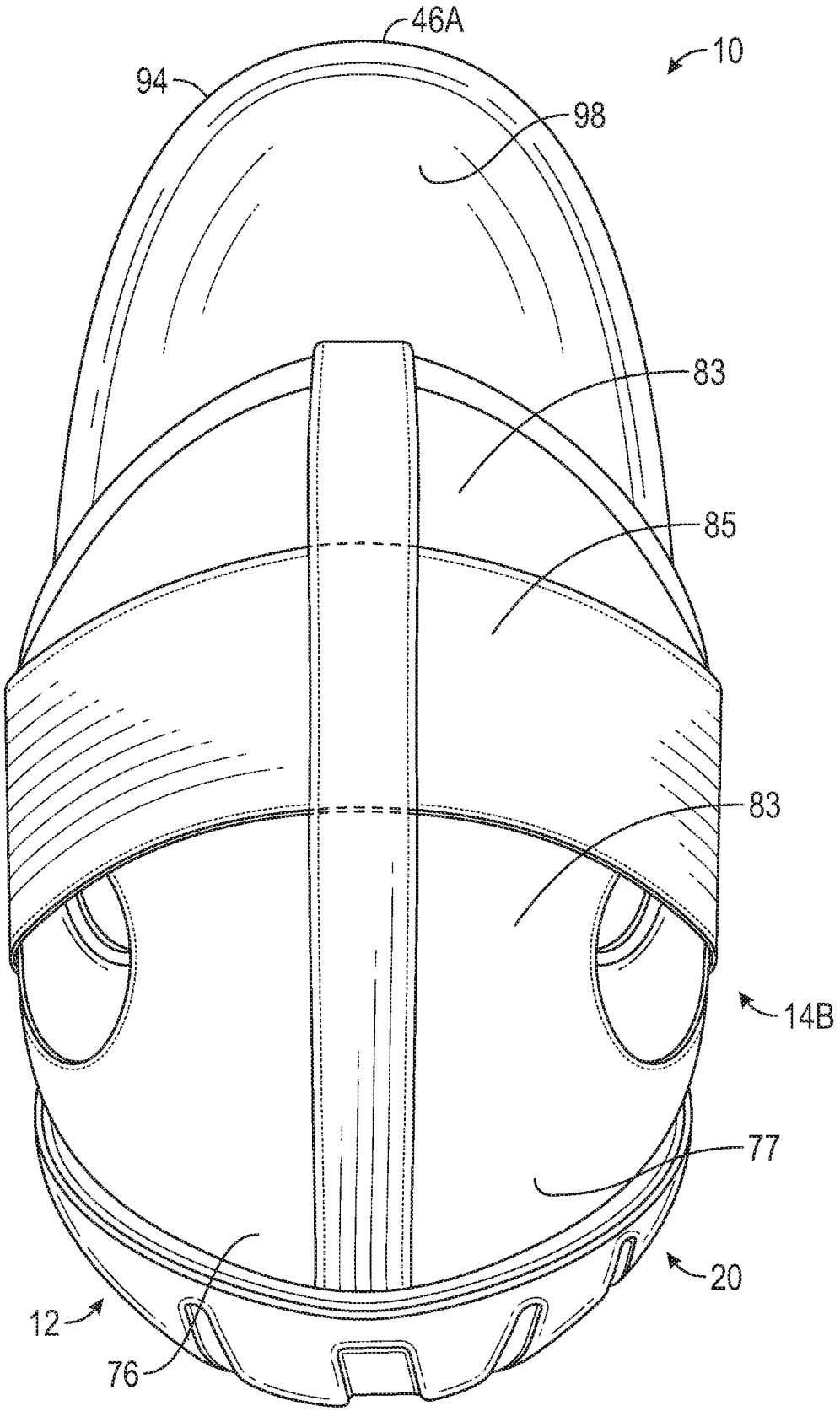
FIG. 5 is a perspective rear view of the article of footwear of FIG. 1.

FIG. 5 best shows the heel support segment 83 extending upwardly from a rear portion 77 of the base 38 at the rear 76 of the heel region 20 and helping to bias the hinged heel section 14B in the closed position, also referred to as a use position. The elastic heel band 85 further biases the hinged heel section 14B to the closed position.

Figure 6:
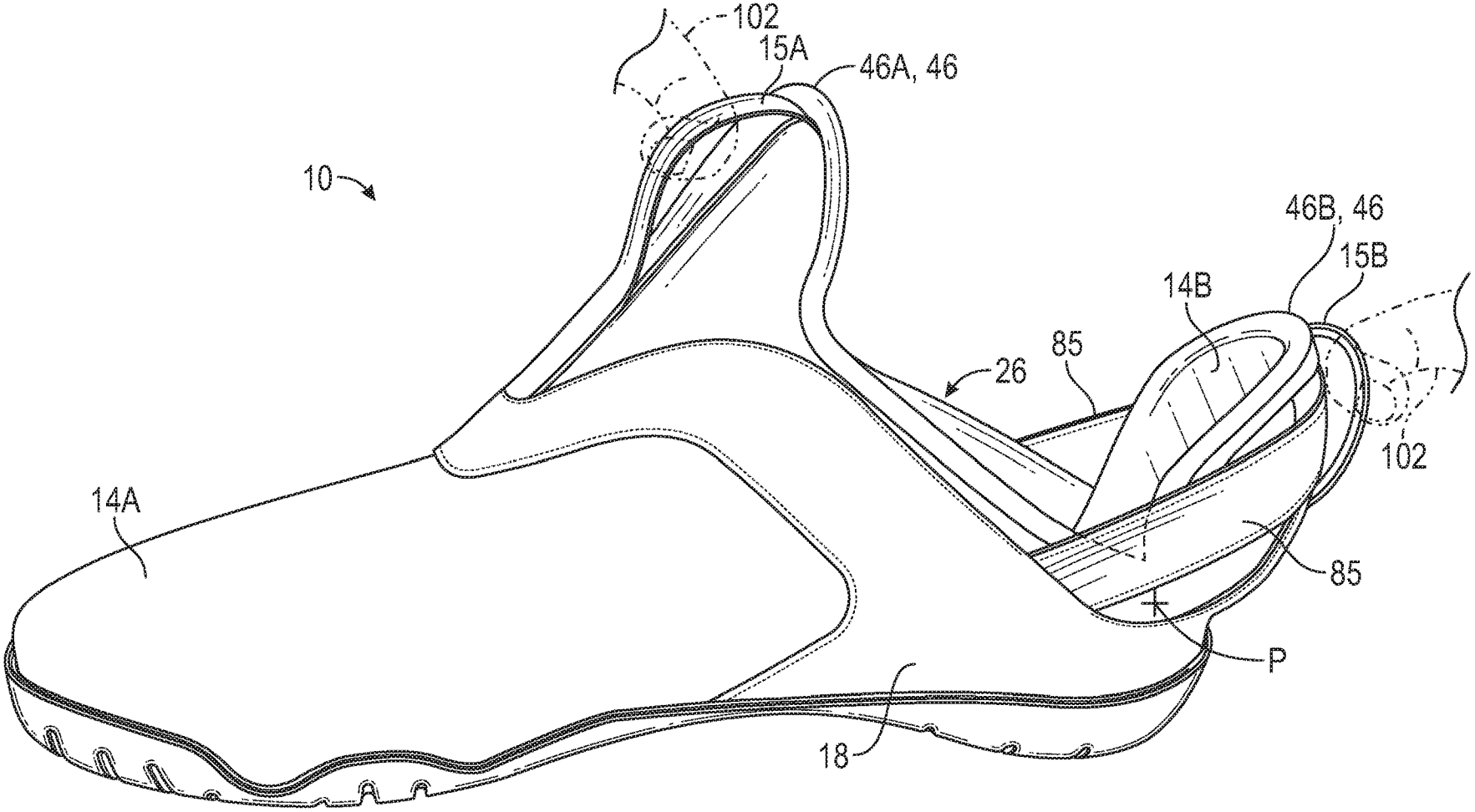
FIG. 6 is a perspective medial side view of the article of footwear of FIG. 1 with a hinged heel section of an upper in an open position.

FIG. 6 shows the hinged heel section 14B pivoted about a pivot axis P to an access position. The heel section 14B is referred to as hinged due to its ability to pivot relative to the front section 14A. The heel section 14B may simply be bendable to pivot in the manner described and need not include additional hinge components in order to pivot. In the access position, the rear edge 46B of the ankle opening 46 is further from the forward edge 46A, thereby widening the ankle opening 46 for easier foot entry into the foot-receiving cavity 26. A wearer's fingers 102 are shown in phantom pulling the pull loops 15A, 15B thereby moving the hinged heel section 14B to the access position. The hinged heel section 14B may also be moved from the closed position to the access position by the wearer's foot pushing downward and rearward on the rear edge 46B. The elastic heel band 85 is tensioned as it stretches to permit movement of the hinged heel section 14B to the access position. When the fingers 102 or other means of opening force are removed, the elastic heel band 85 will resiliently retract to its initial position of FIG. 1, to which it is elastically biased, pulling the hinged heel section 14B to the use position of FIG. 1 in which the hinged heel section 14B cups the rear of a foot placed in the foot-receiving cavity 26.

The following Clauses provide example configurations of an article of footwear disclosed herein.

Clause 1. An article of footwear comprising: an upper including a body and a unitary support frame attached to the body; a sole structure attached to and underlying the upper; the unitary support frame supporting the body over the sole structure, and the body defining a foot-receiving cavity over the sole structure and an ankle opening in communication with the foot-receiving cavity; and the unitary support frame defining a medial peak at a medial side of the article of footwear and a lateral peak at a lateral side of the article of footwear, and the unitary support frame extending forwardly and downwardly from the medial peak and from the lateral peak and around the ankle opening.

Clause 2. The article of footwear of Clause 1, wherein the unitary support frame has a first medial segment extending upwardly and forwardly on the medial side to the medial peak, a first lateral segment extending upwardly and forwardly on the lateral side to the lateral peak, and a front segment extending downwardly and forwardly from the medial peak and the lateral peak.

Clause 3. The article of footwear of Clause 2, wherein the front segment defines a front peak disposed over a central top region of the body and forward of the ankle opening.

Clause 4. The article of footwear of any of Clauses 1-3, wherein the unitary support frame has a front segment disposed forward of the ankle opening, and the article of footwear further comprising: padding secured to the body and extending rearward of the front segment of the unitary support frame to a forward edge of the ankle opening, wherein the padding is thicker than the body.

Clause 5. The article of footwear of Clause 4, wherein a portion of the body is disposed forward of the front segment of the unitary support frame and is characterized by an absence of padding.

Clause 6. The article of footwear of Clause 4, wherein the padding extends upwardly and rearwardly of the front segment of the unitary support frame and partially defines a tongue.

Clause 7. The article of footwear of Clause 6, wherein the body comprises a first material disposed forward of the front segment of the unitary support frame, and a second material disposed rearward of the front segment of the unitary support frame to the ankle opening, the second material further defining the tongue.

Clause 8. The article of footwear of any of Clauses 1-7, wherein the unitary support frame extends continuously from the sole structure at the medial side in a heel region of article of footwear, over the foot-receiving cavity forward of the ankle opening, and to the sole structure at the lateral side in the heel region.

Clause 9. The article of footwear of any of Clauses 1-8, wherein the unitary support frame includes a base extending along the sole structure at a rear of a heel region of the article of footwear from the lateral side to the medial side.

Clause 10. The article of footwear of Clause 9, wherein: the unitary support frame has a first medial segment extending upwardly and forwardly on the medial side to the medial peak, and a first lateral segment extending upwardly and forwardly on the lateral side to the lateral peak; and the first lateral segment and the first medial segment extend upwardly from the base.

Clause 11. The article of footwear of Clause 10, wherein the base includes a medial arm extending forwardly under the first medial segment, and a lateral arm extending forwardly under the first lateral segment.

Clause 12. The article of footwear of Clause 11, wherein: the medial arm tapers in a forward direction of the article of footwear to a medial extremity in a midfoot region of the article of footwear; and the lateral arm tapers in the forward direction to a lateral extremity in the midfoot region.

Clause 13. The article of footwear of Clause 9, wherein the unitary support frame includes a heel support segment that extends upwardly from the base at the rear of the heel region.

Clause 14. The article of footwear of Clause 9, wherein: the upper comprises a front section and a hinged heel section; the front section includes the body; and the hinged heel section is pivotable relative to the body at the rear of the heel region.

Clause 15. The article of footwear of Clause 14, wherein the upper comprises a first pull loop secured to the front section forward of the ankle opening, and a second pull loop secured to the hinged heel section rearward of the ankle opening.

Clause 16. The article of footwear of Clause 14, wherein the upper comprises an elastic heel band extending around the hinged heel section from the medial side to the lateral side.

Clause 17. The article of footwear of Clause 16, wherein: the unitary support frame has a first medial segment extending upwardly and forwardly on the medial side to the medial peak, and a first lateral segment extending upwardly and forwardly on the lateral side to the lateral peak; the elastic heel band extends upwardly and rearwardly from the front section at the medial side and at the lateral side at a first angle relative to a horizontal plane; and the base includes a medial arm extending forwardly under the first medial segment, and a lateral arm extending forwardly under the first lateral segment, an edge of the medial arm of the base and an edge of the lateral arm of the base extending upwardly and rearwardly from the sole structure at the first angle relative to the horizontal plane.

Clause 18. The article of footwear of any of Clauses 1-17, wherein an exterior surface of the body is impermeable to liquid.

Clause 19. The article of footwear of any of Clauses 1-18, wherein the body comprises natural or synthetic leather.

Clause 20. The article of footwear of any of Clauses 1-19, wherein the unitary support frame is attached to an exterior surface of the body.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. As used in the description and the accompanying claims, a value is considered to be "approximately" equal to a stated value if it is neither more than 5 percent greater than nor more than 5 percent less than the stated value. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

a heel region, a forefoot region spaced apart from the heel region, and a midfoot region disposed between the heel region and the forefoot region;

an upper including a body and a unitary support frame attached to the body;

a sole structure attached to and underlying the upper;

the unitary support frame supporting the body over the sole structure, and the body defining a foot-receiving cavity over the sole structure and an ankle opening in communication with the foot-receiving cavity;

the unitary support frame defining a medial peak at a medial side of the article of footwear and a lateral peak at a lateral side of the article of footwear, and extending forwardly and downwardly from the medial peak and from the lateral peak and around the ankle opening;

wherein the unitary support frame is configured as an arch over the sole structure forward of the ankle opening that extends from the lateral side to the medial side to suspend the body over the sole structure and inhibit collapse of the body toward the sole structure;

wherein the unitary support frame is directly attached to the sole structure at the midfoot region and the heel region and is not directly attached to the sole structure at the forefoot region;

wherein the upper comprises a front section and a hinged heel section, the front section includes the body, and the hinged heel section is pivotable relative to the body at a rear of the heel region;

wherein the upper comprises an elastic heel band extending around the hinged heel section from the medial side to the lateral side;

wherein the elastic heel band extends upwardly and rearwardly from the front section at the medial side and at the lateral side at a first angle relative to a horizontal plane; and wherein the unitary support frame includes a medial arm extending forwardly under the medial peak and a lateral arm extending forwardly under the lateral peak, an edge of the medial arm and an edge of the lateral arm extending upwardly and rearwardly from the sole structure at the first angle relative to the horizontal plane.

2. The article of footwear of claim 1, wherein the unitary support frame has a first medial segment extending upwardly and forwardly on the medial side to the medial peak, a first lateral segment extending upwardly and forwardly on the lateral side to the lateral peak, and a front segment extending downwardly and forwardly from the medial peak and the lateral peak.

3. The article of footwear of claim 2, wherein the front segment defines a front peak disposed over a central top region of the body and forward of the ankle opening.

4. The article of footwear of claim 1, wherein the unitary support frame has a front segment disposed forward of the ankle opening, and the article of footwear further comprising:

padding secured to the body and extending rearward of the front segment of the unitary support frame to a forward edge of the ankle opening, wherein the padding is thicker than the body.

5. The article of footwear of claim 4, wherein a portion of the body is disposed forward of the front segment of the unitary support frame and is characterized by an absence of padding.

6. The article of footwear of claim 4, wherein the padding extends upwardly and rearwardly of the front segment of the unitary support frame and partially defines a tongue.

7. The article of footwear of claim 6, wherein the body comprises a first material disposed forward of the front segment of the unitary support frame, and a second material disposed rearward of the front segment of the unitary support frame to the ankle opening, the second material further defining the tongue.

8. The article of footwear of claim 1, wherein the unitary support frame extends continuously from the sole structure at the medial side in the heel region of article of footwear, over the foot-receiving cavity forward of the ankle opening, and to the sole structure at the lateral side in the heel region.

9. The article of footwear of claim 1, wherein the unitary support frame includes a base extending along the sole structure at a rear of the heel region of the article of footwear from the lateral side to the medial side.

10. The article of footwear of claim 9, wherein:

the unitary support frame has a first medial segment extending upwardly and forwardly on the medial side to the medial peak, and a first lateral segment extending upwardly and forwardly on the lateral side to the lateral peak; and the first lateral segment and the first medial segment extend upwardly from the base.

11. The article of footwear of claim 10, wherein the base includes a medial arm extending forwardly under the first medial segment, and a lateral arm extending forwardly under the first lateral segment.

12. The article of footwear of claim 11, wherein:

the medial arm tapers in a forward direction of the article of footwear to a medial extremity in the midfoot region of the article of footwear; and the lateral arm tapers in the forward direction to a lateral extremity in the midfoot region.

13. The article of footwear of claim 9, wherein the unitary support frame includes a heel support segment that extends upwardly from the base at the rear of the heel region.

14. The article of footwear of claim 1, wherein the upper comprises a first pull loop secured to the front section forward of the ankle opening, and a second pull loop secured to the hinged heel section rearward of the ankle opening.

15. The article of footwear of claim 1, wherein an exterior surface of the body is impermeable to liquid.

16. The article of footwear of claim 1, wherein the body comprises natural or synthetic leather.

17. The article of footwear of claim 1, wherein the unitary support frame is attached to an exterior surface of the body.

18. An article of footwear comprising:

a heel region, a forefoot region spaced apart from the heel region, and a midfoot region disposed between the heel region and the forefoot region;

an upper including a body and a unitary support frame attached to the body;

a sole structure attached to and underlying the upper;

the unitary support frame supporting the body over the sole structure, and the body defining a foot-receiving cavity over the sole structure and an ankle opening in communication with the foot-receiving cavity;

the unitary support frame defining a medial peak at a medial side of the article of footwear and a lateral peak at a lateral side of the article of footwear, and extending forwardly and downwardly from the medial peak and from the lateral peak and around the ankle opening;

wherein the unitary support frame is configured as an arch over the sole structure forward of the ankle opening that extends from the lateral side to the medial side to suspend the body over the sole structure and inhibit collapse of the body toward the sole structure;

wherein the unitary support frame is directly attached to the sole structure at the midfoot region and the heel region and is not directly attached to the sole structure at the forefoot region;

wherein the unitary support frame includes a base extending along the sole structure at a rear of the heel region of the article of footwear from the lateral side to the medial side, the upper comprises a front section and a hinged heel section, the front section includes the body, and the hinged heel section is pivotable relative to the body at the rear of the heel region;

wherein the upper comprises an elastic heel band extending around the hinged heel section from the medial side to the lateral side;

wherein the unitary support frame has a first medial segment extending upwardly and forwardly on the medial side to the medial peak, and a first lateral segment extending upwardly and forwardly on the lateral side to the lateral peak;

wherein the elastic heel band extends upwardly and rearwardly from the front section at the medial side and at the lateral side at a first angle relative to a horizontal plane; and wherein the base includes a medial arm extending forwardly under the first medial segment, and a lateral arm extending forwardly under the first lateral segment, an edge of the medial arm of the base and an edge of the lateral arm of the base extending upwardly and rearwardly from the sole structure at the first angle relative to the horizontal plane.

* * * * *